US009848265B2

(12) United States Patent
Wen et al.

(10) Patent No.: US 9,848,265 B2
(45) **Date of Patent: *Dec. 19, 2017**

(54) LED LIGHTING DEVICE AND SPEAKER

(71) Applicant: ZHEJIANG SHENGHUI LIGHTING CO., LTD, Jiaxing (CN)

(72) Inventors: Caifang Wen, Jiaxing (CN); Xia Wang, Jiaxing (CN); Jinxiang Shen, Jiaxing (CN); Chaoqun Sun, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/152,059

(22) Filed: May 11, 2016

(65) Prior Publication Data

US 2016/0255437 A1 Sep. 1, 2016

Related U.S. Application Data

(63) Continuation of application No. 14/488,772, filed on Sep. 17, 2014, now Pat. No. 9,363,592, which is a (Continued)

(30) Foreign Application Priority Data

Jan. 14, 2013 (CN) ..... 2013 1 0013677
Aug. 1, 2013 (CN) ..... 2013 1 0332830

(51) Int. Cl.
*H04R 1/02* (2006.01)
*H04R 5/02* (2006.01)
(Continued)

(52) U.S. Cl.
CPC ..... *H04R 5/02* (2013.01); *F21K 9/23* (2016.08); *F21V 17/164* (2013.01);
(Continued)

(58) Field of Classification Search
CPC .... G08C 17/02; G08C 2201/93; G08C 23/02; H04N 7/183; H04N 21/4126;
(Continued)

(56) References Cited

U.S. PATENT DOCUMENTS 7,997,772 B2 8/2011 Avtzon et al.
9,363,592 B2 * 6/2016 Wen ..... F21V 23/009
(Continued)

FOREIGN PATENT DOCUMENTS

CN 201414274 Y 2/2010
CN 201697092 U 1/2011
(Continued)

OTHER PUBLICATIONS

The World Intellectual Property Organization (WIPO) International Search Report for PCT/CN2014/082061 dated Oct. 9, 2014.
(Continued)

*Primary Examiner* — Md S Elahee
*Assistant Examiner* — Julie X Dang
(74) *Attorney, Agent, or Firm* — Anova Law Group, PLLC

(57) ABSTRACT

The present invention provides a multifunctional LED device and multifunctional speaker system. The multifunctional LED device includes a power supply unit; a control unit configured to process audio signals and control commands; an audio power amplifier configured to drive a speaker; a speaker; a first wireless transceiver configured to communicate with a smart terminal; a second wireless transceiver configured to communicate with other LED devices; and an LED light source. The multifunctional speaker system includes several multifunctional wireless LED devices configured to works as wireless speakers, and a smart terminal to control the system remotely. The smart terminal may communicate with and control all the multi-
(Continued)

functional LED devices. The multifunctional LED devices may communicate with each other. Two multifunctional LED devices may be configured as a 2.0-channel speaker system. Other speaker systems, such as 2.1-channel, 5.1-channel speaker systems, may be realized using more multifunctional wireless LED devices.

19 Claims, 7 Drawing Sheets

Related U.S. Application Data continuation of application No. PCT/CN2014/082061, filed on Jul. 11, 2014, application No. 15/152,059, which is a continuation of application No. 14/291,180, filed on May 30, 2014, now Pat. No. 9,438,976, which is a continuation-in-part of application No. PCT/CN2013/072802, filed on Mar. 18, 2013.

(51) Int. Cl.

| | |
|---|---|
| ***F21V 33/00*** | (2006.01) |
| ***F21V 23/00*** | (2015.01) |
| ***F21K 9/23*** | (2016.01) |
| ***F21V 17/16*** | (2006.01) |
| ***H05B 33/08*** | (2006.01) |
| ***H05B 37/02*** | (2006.01) |
| *H04R 9/02* | (2006.01) |
| *H04R 1/28* | (2006.01) |
| *F21Y 101/00* | (2016.01) |

(52) U.S. Cl.

CPC ..... *F21V 23/009* (2013.01); *F21V 33/0056* (2013.01); *H04R 1/028* (2013.01); *H05B 33/0845* (2013.01); *H05B 33/0857* (2013.01); *H05B 37/0236* (2013.01); *H05B 37/0272* (2013.01); *F21Y 2101/00* (2013.01); *H04R 1/2803* (2013.01); *H04R 9/022* (2013.01); *H04R 2420/07* (2013.01)

(58) Field of Classification Search

CPC ..... H04N 21/4147; H04N 21/436; H04N 21/482; H04N 5/2252; H04N 5/2256; H04N 5/23203; H04N 5/765; H04R 1/028; H04R 2420/07

USPC ..... 381/300, 386, 396

See application file for complete search history.

(56) References Cited

U.S. PATENT DOCUMENTS

| | | | | |
|---|---|---|---|---|
| 2007/0086724 | A1* | 4/2007 | Grady ..... | H04N 5/765 386/230 |
| 2008/0285271 | A1 | 11/2008 | Roberge et al. | |
| 2009/0034778 | A1 | 2/2009 | Chi | |
| 2009/0050615 | A1 | 2/2009 | Fis-Menache | |
| 2010/0142330 | A1 | 6/2010 | Reygaert | |
| 2011/0317846 | A1 | 12/2011 | Yuan et al. | |
| 2012/0126700 | A1 | 5/2012 | Mayfield et al. | |
| 2013/0016864 | A1 | 1/2013 | Ivey et al. | |
| 2013/0294050 | A1 | 11/2013 | Lee et al. | |

FOREIGN PATENT DOCUMENTS

| | | | |
|---|---|---|---|
| CN | 102032543 | A | 4/2011 |
| CN | 102300133 | A | 12/2011 |
| CN | 102647640 | A | 8/2012 |
| CN | 102858060 | A | 1/2013 |
| CN | 103414963 | A | 11/2013 |
| CN | 203406983 | U | 1/2014 |

OTHER PUBLICATIONS

The World Intellectual Property Organization (WIPO) International Search Report for PCT/CN2013/072802 dated Oct. 24, 2013.

* cited by examiner

LED LIGHTING DEVICE AND SPEAKER

CROSS-REFERENCES TO RELATED APPLICATIONS

This application is a continuation application of U.S. patent application Ser. No. 14/488,772, filed on Sep. 17, 2014, which is a continuation application of International Patent Application PCT/CN2014/082061, filed on Jul. 11, 2014, which claims priority of Chinese Patent Application No. 201310332830.X, filed on Aug. 1, 2013; and a continuation application of U.S. patent application Ser. No. 14/291,180, filed on May 30, 2014, which is a continuation-in-part application of International Patent Application PCT/CN2013/072802, filed on Mar. 18, 2013, which claims priority of Chinese Patent Application No. 201310013677.4, filed on Jan. 14, 2013, the entire contents of all of which are incorporated herein by reference.

FIELD OF THE DISCLOSURE

The present disclosure relates to the field of light emitting diode (LED) technologies and, more particularly, relates to an LED lighting device and speaker, a multifunctional LED device and a multifunctional speaker system.

BACKGROUND

LEDs provide controllable lighting and solid-state lighting. They consume less power than traditional lighting devices, and are environmentally friendly. Over time, LEDs have been widely used for various lighting applications such as public place lightings, office and indoor lightings, etc.

Speakers play an important role in modern daily life entertainment. To provide lighting and play music at the same time, current LED lighting device and speaker designs combine speakers and LEDs into one integrated device. However, the present designs of such devices often simply place a speaker onto an LED lighting device to provide lighting and audio playing capabilities. As a result, the resulting device often has poor heat dissipation capacity, low quality bass, and may be difficult to manufacture.

Wireless technologies enable users to reduce the amount of wirings needed to set up equipment. Wireless technologies are widely used in modern electronics. LEDs provide controllable lighting and solid-state lighting. They consume less power than traditional lighting devices and are environmentally friendly. Overtime, LEDs have been widely used in various lighting applications such as public place lightings, office and indoor lightings, etc. Wireless control of LED lighting devices provides functions such as remotely switching devices on/off, adjusting lighting, dimming devices, etc. Wireless control of LEDs is well received by the consumers because it is convenient and easy to use.

Many traditional speaker systems reply on wired connections. These systems are large and often difficult to install. Further, traditional speaker systems often need a separate transceiver to send and receive audio signals and control signals. This type of system configurations may make the speaker system large and expensive to install. As smartphones and other portable devices are being used widely as control terminals, the traditional set-up for the speaker systems has become out-of-date.

The present disclosure is directed to solve one or more problems set forth above and other problems.

BRIEF SUMMARY OF THE DISCLOSURE

Embodiments consistent with the present disclosure provide an LED lighting device and a speaker. This LED lighting device and speaker may deliver high quality bass, and dissipate heat efficiently. This LED lighting device and speaker also have a simplified structure.

In one embodiment, an LED lighting device and speaker includes an LED lighting unit configured to emit light, a speaker configured to play audio signals, an outer casing configured to hold the LED lighting unit and speaker, and a power supply module configured to supply power to the LED lighting unit and speaker. Further, the LED lighting unit and the speaker are fixed on a top surface of the outer casing by screws. The outer casing includes a sound guiding tube.

Moreover, the outer casing and the sound guiding tube may be fully integrated. The outer casing may have a hollow structure and a concave top surface. The sound guiding tube may run through the top surface of the outer casing. One end of the sound guiding tube may protrude above the top surface of the outer casing. The other end of the sound guiding tube may extend toward a bottom surface of the outer casing and maintain a gap between itself and the bottom surface.

In addition, the LED lighting unit and the speaker may be set on the top surface of the outer casing by screws. The sound guiding tube may have a hollow structure with both ends being open. The cross section of the sound guiding tube may be round. The lampshade has a hollowed out design and snaps into the outer casing.

Finally, the power supply module may include a power supply, a base with a hollow interior, and a light socket. The outer casing may be connected to the base. The power supply may be placed in the base. The power supply may be connected to the light socket and to the LED lighting unit. The base may be connected to the outer casing by screws.

Embodiments consistent with the present disclosure may expand the audio bandwidth of the speaker, enhance the quality of bass, and reduce speaker vibration displacements, which protects the speaker. Further, the gap between the sound guiding tube and the bottom of the outer casing provides a heat dissipation path for the heat generated by the power supply module. In addition, the sound guiding tube and the hollowed lampshade forms a path that increases the air circulation between the interior and exterior of the LED lighting device and speaker. Finally, the sound guiding tube adds to the heating dissipating surface of the LED lighting device and speaker and therefore improves the efficiency of heat dissipation.

Embodiments consistent with the present disclosure provide a multifunctional LED device and a multifunctional speaker system that are easy to wire. Such systems do not need to include a separate wireless transceiver or certain peripherals such as a remote control unit or a light switch.

One aspect of the present disclosure provides a multifunctional wireless LED device. The multifunctional LED device may include an LED power supply unit configured to supply power to an LED lighting unit and drive the LED device; a wireless transceiver configured to receive and send audio signals and control signals to and from a smart terminal; and a control unit configured to process audio signals and control signals and to control components of the LED device. The wireless transceiver may send the received signals to the control unit for further processing. The multifunctional LED device may further include a speaker configured to play audio signals; an audio power amplifier configured to receive processed audio signals from the control unit and to drive the speaker; and an LED lighting unit configured to emit light. The LED lighting unit receives control signals from the control unit and adjusts light emission accordingly.

Moreover, the multifunctional LED device may include an audio codec unit that is connected to the control unit and the audio power amplifier. The audio codec unit may send the audio signals processed by the control unit to the audio power amplifier.

Another aspect of the present disclosure provides another multifunctional wireless LED device. The multifunctional LED device may include an LED power supply unit configured to supply power to an LED lighting unit and drive the LED device; a wireless transceiver configured to receive and send audio signals and control signals, and send the received signals to other multifunctional LED devices; and a control unit configured to process audio signals and controlling commands and to control components of the LED device. The wireless transceiver may send received signals to the control unit for further processing. The multifunctional LED device may further include a speaker configured to play audio signals; an audio power amplifier configured to receive processed audio signals from the control unit and to drive the speaker; and an LED lighting unit configured to emit light. The LED lighting unit receives control signals from the control unit and adjusts the light emission accordingly.

Moreover, the multifunctional LED device may include an audio codec unit that is connected to the control unit and the audio power amplifier. The audio codec unit may send the audio signals processed by the control unit to the audio power amplifier.

Moreover, the control unit of the multifunctional LED device may be a micro-controller, digital signal processor, or IC controller, or a combination thereof. The control unit processes audio signals.

The wireless transceiver of the multifunctional LED device may support frequency bands such as 2.4 GHz, 5.2 GHz, 5.8 GHz, or a combination of the above working frequencies and support bi-directional transmission.

Another aspect of the present disclosure provides a multifunctional sound system. The multifunctional sound system may include two multifunctional LED devices each having two wireless transceivers; and a smart terminal configured to monitor and remotely control the multifunctional LED devices. Further, one of the two multifunctional LED devices may receive signals from the smart terminal and send the received signals to the other multifunctional LED device.

Further, the smart terminal may set a first multifunctional LED device as a central device, and a second multifunctional LED device as a receiving device. The first central device may receive control signals or audio signals from the smart device and send the signals to the receiving device.

Another aspect of the present disclosure provides another multifunctional sound system. The multifunctional sound system includes a first multifunctional LED device with two wireless transceivers; a second multifunctional LED device with one wireless transceiver; and a smart terminal configured to monitor and remotely control the multifunctional LED devices. Further, the first multifunctional LED devices may receive signals from the smart terminal and send the received signals to the second multifunctional LED device. The smart terminal may be a smartphone, a smart TV, a tablet, a desktop computer, or a wireless Dongle, etc.

During the operations of a first multifunctional LED device (with two wireless transceivers), the power supply of the multifunctional LED device may power up the LED lighting unit and the multifunctional LED device. The smart terminal may send wireless audio signals and control signals to the first wireless transceiver. The first wireless transceiver may send the audio signals and control signals to the control unit. The control unit may process the received signals and send the processed signals to the second wireless transceiver and/or the audio power amplifier. The second wireless transceiver may send the audio signals and control signals to other multifunctional LED devices. The control unit may send feedback signals to the smart terminal.

Embodiments consistent with the present disclosure are easy to install, require little wiring, and do not require adding a separate transceiver, a separate remote control unit, or a separate light switch. Embodiments consistent with the present disclosure support wireless lighting control and provide efficient lighting. Embodiments consistent with the present disclosure may be low cost, relatively small, and suitable for various lighting and audio applications in residential and commercial settings.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
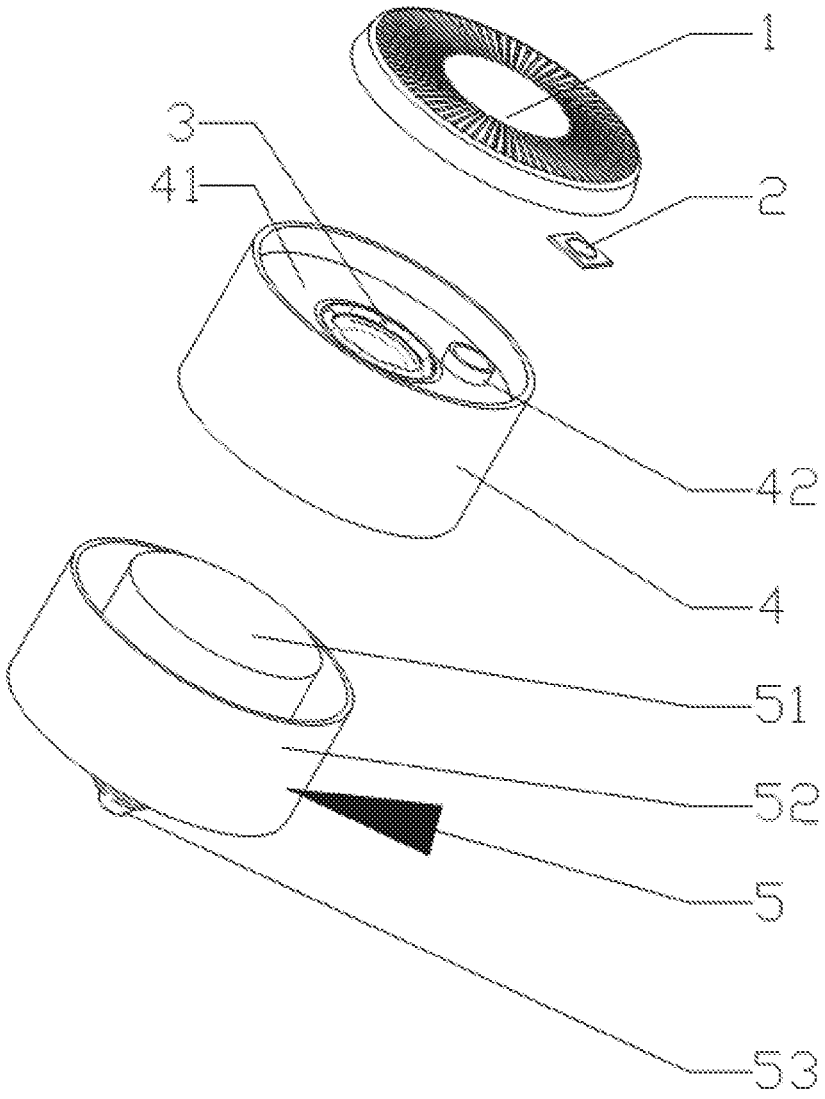
FIG. 1 is an exploded view of an exemplary LED lighting device and speaker consistent with various embodiments of the present disclosure.

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

An exemplary embodiment consistent with the present disclosure is described below. FIG. 1 to FIG. 4 illustrate an exemplary configuration of an LED lighting device and speaker consistent with the present disclosure. The LED lighting device and speaker may include a lampshade 1, an LED lighting unit 2, a speaker 3, an outer casing 4, and a power supply module 5. The power supply module 5 may further include a power supply 51, a base 52, and a light socket 53.

As shown in FIG. 1, the base 52 may have a hollow interior. The power supply 51 may be placed inside the base 52. The power supply 51 may be connected to the light socket 53 and the LED lighting unit 2.

In this embodiment, the outer casing 4 may be a cylinder with a hollow interior and a concave top surface 41. The LED lighting unit 2 and the speaker 3 may be fixed to the top surface 41 by screws (not shown here). The lampshade 1 may snap into the outer casing 4. The snap structure may use designs that are well known to those skilled in the art. The base 52 and the outer casing 4 may be connected together by screws.

Figure 2:
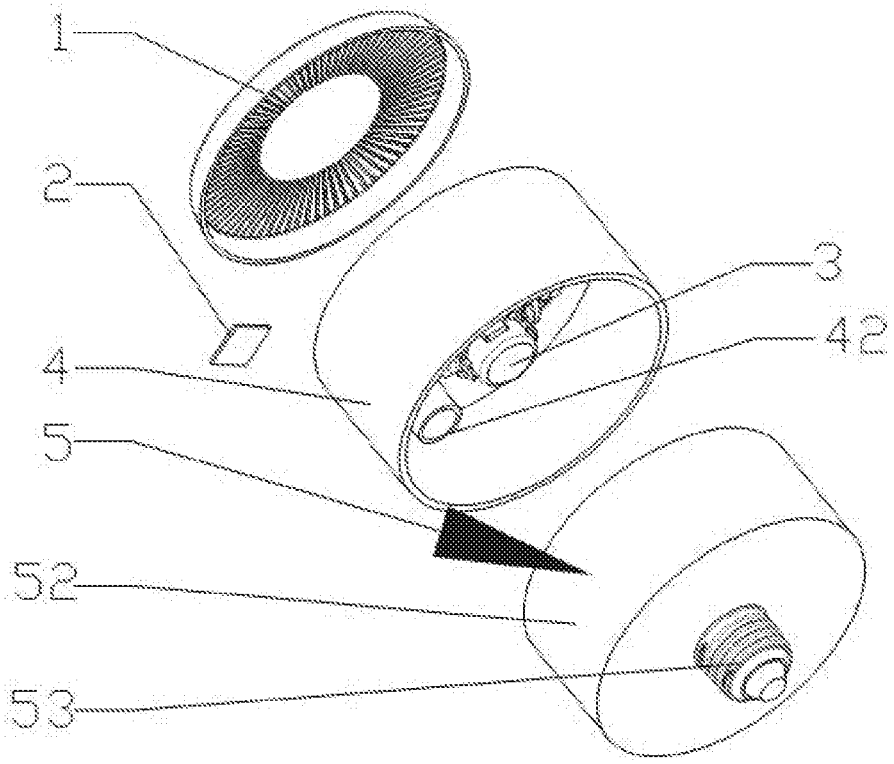
FIG. 2 is an exploded view from another viewpoint of an exemplary LED lighting device and speaker consistent with various embodiments of the present disclosure.
Figure 3:
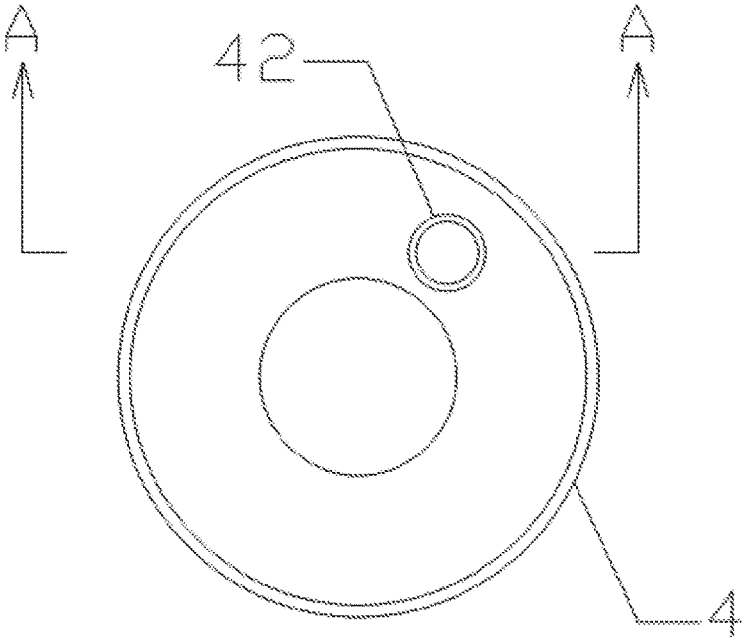
FIG. 3 is a schematic illustrating the structure of the outer casing of an exemplary LED lighting device and speaker consistent with various embodiments of the present disclosure.
Figure 4:
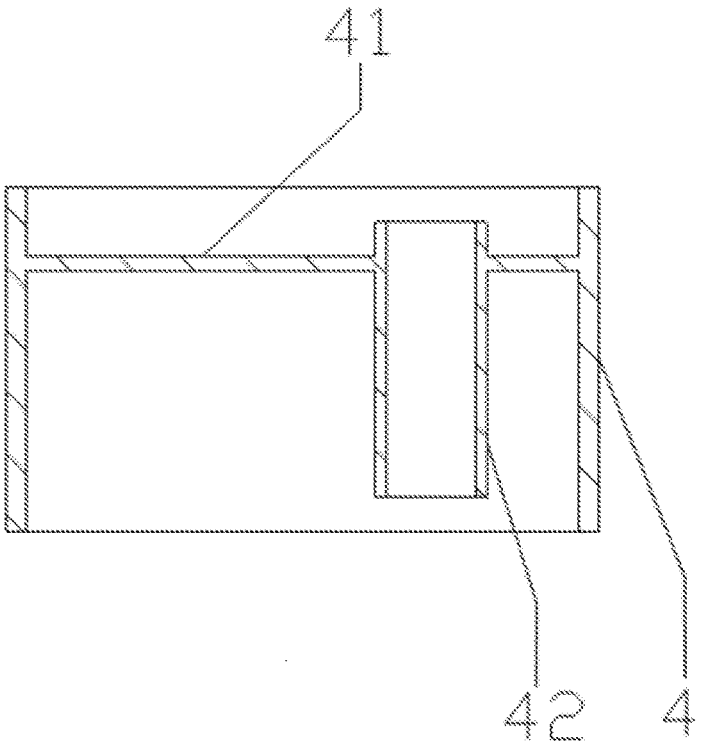
FIG. 4 is the A-A cross sectional view of the structure of the outer casing of an exemplary LED lighting device and speaker consistent with various embodiments of the present disclosure.

As shown in FIG. 1, FIG. 2 and FIG. 4, the outer casing 4 may include a sound guiding tube 42. The sound guiding tube 42 may be integrated together with the outer casing 4 as one piece. One end of the sound guiding tube 42 may protrude out of the top surface 41. The other end of the sound guiding tube 42 may extend toward the bottom surface of the outer casing 4, but stay above the bottom surface. As a result, a gap may be formed between the lower end of the sound guiding tube 42 and the bottom surface of the outer casing 4.

The sound guiding tube 42 may have a circular shaped cross section as shown in this embodiment. The sound guide tube 42 may be designed to use tubes of different cross sectional shapes such as square, polygon, etc. Moreover, the sound guiding tube 42 may expand the audio bandwidth of the speaker and may improve its bass quality. The sound guide tube 42 may also reduce the vibration displacement of the speaker 3, which may better protect the speaker 3.

As shown in FIG. 1 and FIG. 2, the lampshade 1 may have a hollowed out design. The sound guiding tube 42 may therefore connect the internal air (of the power supply chamber) to the external air. As a result, heat generated by the power supply 51 may be dissipated efficiently through convection. Further, the sound guiding tube 42 adds to the surface area of the outer casing 4, which improves the heat dissipation efficiency.

The design, including the material, shape, size, or position, of the sound guiding tube 42 may be determined based on the internal space of the LED lighting device and speaker, the power of the speaker, the desirable sound effect, etc. For example, the length of the sound guiding tube may be adjusted to achieve better sound quality or better heat dissipation. In another example, multiple sound guiding tubes may also be used to achieve better sound quality or better heat dissipation. Further, the thickness or the material of the sound guiding tube 42 may be selected to improve heat dissipation efficiency. In addition, the position of the sound guiding tube 42 may also be adjusted to achieve better vibration displacement reduction.

Figure 5:
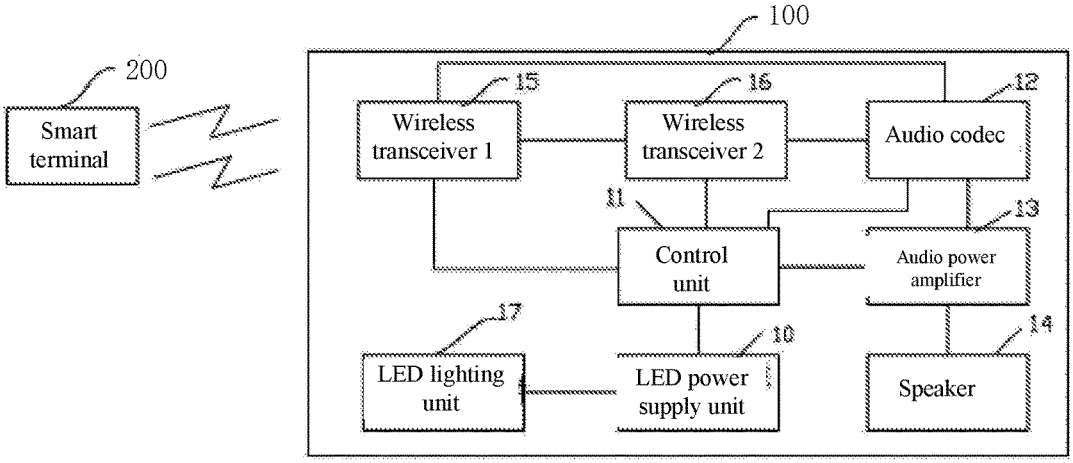
FIG. 5 is a block diagram of an exemplary multifunctional LED device consistent with various disclosed embodiments.

An exemplary embodiment consistent with the present disclosure is described below. FIG. 5 illustrates an exemplary configuration of a multifunctional LED device consistent with the present disclosure. The multifunctional LED device 100 may include a smart terminal 200, an LED power supply unit 10, a control unit 11, an audio codec unit 12, an audio power amplifier 13, a speaker 14, a first wireless transceiver 15, a second wireless transceiver 16, and an LED lighting unit 17. The multifunctional LED device 100 may have similar structure and components as the LED lighting device and speaker disclosed in FIGS. 1-4. For example, the speaker 14 may be the same as the speaker 3. The LED lighting unit 17 may be the same as the LED lighting unit 2.

As shown in FIG. 5, the LED power supply unit 10 may drive the LED lighting unit 17 and supply power to the LED device 100. The first wireless transceiver 15 may receive digital audio signals and controlling signals from a smart terminal 200. The first wireless transceiver 15 may then send the received data to the control unit 11. The control unit 11 may process the digital audio signals, and may send the processed audio signals to the second wireless transceiver 16. The wireless transceiver 15 may send the received digital audio signal to the audio codec unit 12. The audio codec unit 12 may code/decode the received audio signals, and may send the processed audio signals to the audio power amplifier 13. The audio codec unit 12 may be connected to the second wireless transceiver 16. The control unit 11 may send feedback information to the smart terminal 200 through the first wireless transceiver 15. The first wireless transceiver 15 may also be connected to the second wireless transceiver 16.

Further, the control unit 11 may process the received audio signals using various algorithms. The control unit 11 may be a microprocessor, a digital processor, a digital integrated circuit (IC), or a combination thereof. The first wireless transceiver 15 may receive digital audio signals and controlling signals from the smart terminal 200 and send the received signals to the control unit 11. The control unit 11 may process the digital audio signals and control signals, and send the processed signals to the audio power amplifier 13 and the wireless transceiver 16. The audio power amplifier 13 may be connected to the speaker 14. The control unit 11 may communicate with the second wireless transceiver 16. The control unit 11 may also use the second wireless transceiver 16 to communicate with other LED devices.

In some embodiments, the first wireless transceiver 15 and second wireless transceiver 16 may support frequency bands such as 2.4 GHz, 5.2 GHz, 5.8 GHz, and other working frequencies or the combinations thereof. They may be capable of both receiving and sending data. They may be connected to the internet or a local area network to realize remote control of multifunctional LED devices.

The LED power supply unit 10 may supply the power for the LED lighting unit 17. In some embodiments, the control unit 11 may be connected to the LED power supply unit 10. After receiving control signals, the control unit 11 may generate Pulse Width Modulation (PWM) waves. The control unit 11 may generate PWM signals with a set frequency and an adjustable duty cycle or PWM signals with a set duty cycle with an adjustable frequency. These PWM signals may be sent to the power supply unit 10 to control the LED lighting unit 17.

Moreover, the smart terminal 200 can be a smartphone, a smart television, a tablet, a desktop computer, a wireless dongle, and/or other computing devices.

Figure 6:
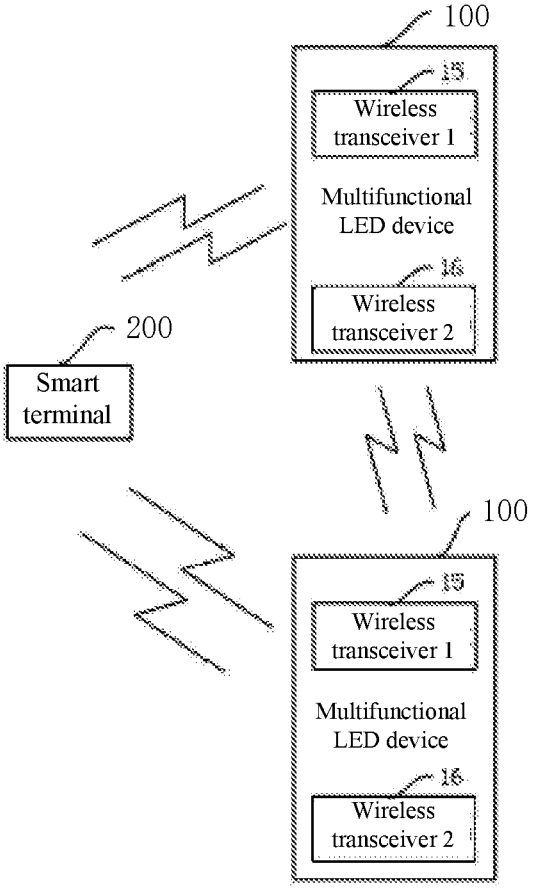
FIG. 6 is a block diagram of an exemplary multifunctional speaker system consistent with various disclosed embodiments.

FIG. 6 is an exemplary embodiment of a multifunctional speaker system consistent with present disclosure. The system may include several above-mentioned multifunctional LED devices 1 and smart terminals 200. A smart terminal 200 may communicate with any of the multifunctional LED devices 100 in the system. In addition, the multifunctional LED devices 1 may communicate among themselves. As shown in FIG. 6, two multifunctional LED devices 1 may be configured to form a 2-channelspeaker system. More multifunctional LED devices may be added to the system to form 2.1-channel, 5.1-channel, or 7.1-channel speaker systems. In theory, any number of audio channels in the wireless speaker system may be realized through this method.

Each multifunctional LED device 100 may include a first wireless transceiver 15 and a second wireless transceiver 16. The multifunctional speaker system may set one of the multifunctional LED devices 1 as a central unit, and set the other the multifunctional LED device as a receiving unit. The central unit may receive audio signals and control signals from the smart terminal 200, and then send the received information to other receiving units within its coverage.

Figure 7:
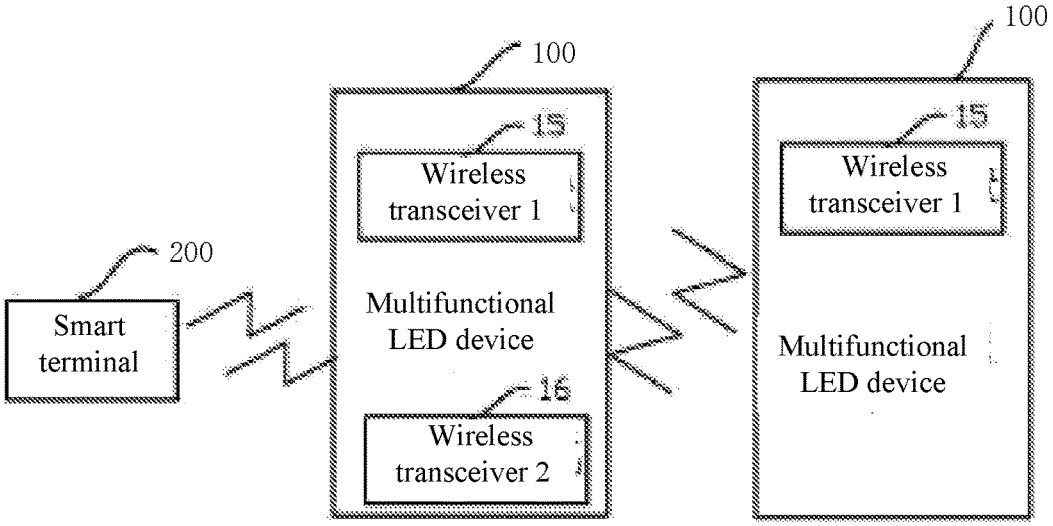
FIG. 7 is another block diagram of an exemplary multifunctional speaker system consistent with various disclosed embodiments.

As shown in FIG. 7, in one embodiment, the multifunctional speaker system may include a number of the multifunctional LED devices. One of the multifunctional LED devices includes a first wireless transceiver 15 and a second wireless transceiver 16. The rest of the multifunctional LED devices may only include second wireless transceivers 16. The smart terminal 200 may set the one multifunctional LED devices with two wireless transceivers as a central unit, and set the rest of the one-transceiver multifunctional LED devices as receiving units. The central unit may receive audio signals and control signals from the smart terminal 200, and then send the received information to other receiving units within its coverage.

In some embodiments, the smart terminal 200 may act as the central control unit. The multifunctional LED devices may form a star and/or mesh network. The central control unit may control each of the devices in the network.

Figure 8:
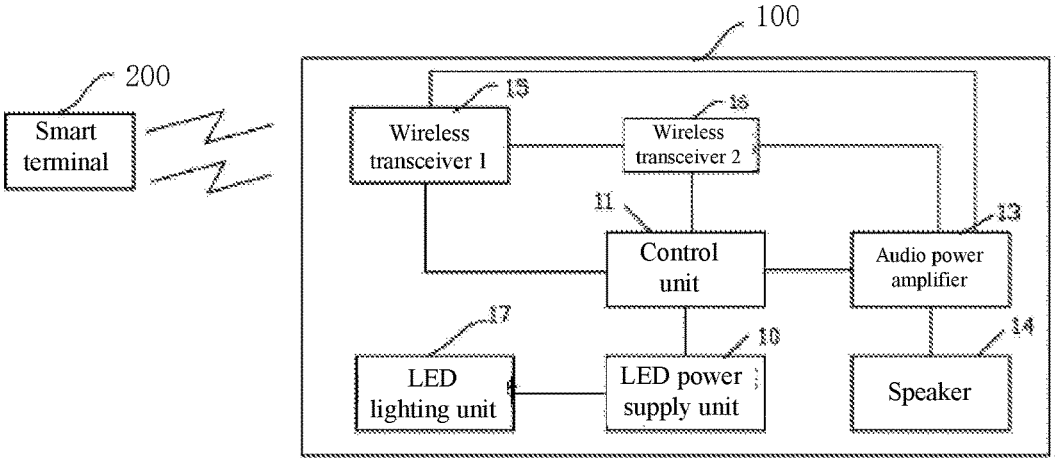
FIG. 8 is another block diagram of an exemplary multifunctional LED device consistent with various disclosed embodiments.

FIG. 8 shows another embodiment of the multifunctional LED device. In FIG. 8, the multifunctional LED device does not include an audio codec unit. After receiving audio signals and control signals from the first wireless transceiver 15, the control unit 11 may process the audio signals according to predefined algorithms. The control unit 11 may then send the processed audio signals to the audio power amplifier 13 and the second wireless transceiver 16. The second wireless transceiver 16 may be connected to the audio power amplifier 13. The audio power amplifier 13 may be connected to the speaker unit 14.

In various embodiments, the multifunctional LED device 100 can be configured as one single device. For example, the at least one power supply unit, the at least one control unit, the at least one audio power amplifier unit, the at least one wireless transceiver, the at least one speaker unit, and/or the at least one audio codec unit, can be integrated into the one LED lighting device 100 to form the single device. Accordingly, the multifunctional speaker system can include a plurality of the multifunctional LED devices each configured as one single device.

In an exemplary multifunctional LED device 100, the speaker unit 14 can be integrated together with driver circuit of the LED drive and power supply unit 10 to save space and to reduce wire loss on of a distributed design. In one embodiment, to ensure the transceiver 15/16 functions as the wireless transceiver module as desired, an embedded antenna can be included in the integrated multifunctional LED device 100. The embedded antenna can be configured to fit a shape of the lamp body of the multifunctional LED device 100 without increasing the size of the resultant device and to maintain the design of the resultant device.

In various embodiments, the wireless transceivers 15 and 16 may also be configured with automatic frequency hopping functions to avoid interference with other radio devices. Furthermore, noise reduction and/or echo cancellation technologies can be applied using software and hardware products to provide the multifunctional LED device 100 with desired audio effects.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

In some embodiments consistent with the present disclosure, an RF module may be added to the LED lighting device and speaker. The RF module may enable users to control the LED lighting device and speaker remotely, such as switching the device on/off, adjusting light and sound settings, etc. The RF module may also connect the LED lighting device and speaker to the internet to stream music online.

In some embodiments consistent with the present disclosure, a Bluetooth module may be included in the LED lighting device and speaker. The LED lighting device and speaker may be paired with a smart phone, a tablet, etc. through the Bluetooth module. A user may install an application on the smartphone or tablet to control lighting or play music stored on the device.

In some embodiments consistent with the present disclosure, multiple LED lighting device and speakers may be configured to form 2.0-channel, 2.1-channel, 5.1-channel, etc. audio systems. Further, the LED lighting unit may be configured to change its light colors or light intensities according to the rhythm or volume of the music played through the speaker.

In some embodiments, the multifunctional LED device 100 may include one or more sensors for detecting objects or movements of objects in a room. The control unit 11 may then control the multifunctional LED devices 100 based on the data received from the sensors. For example, in a room using multiple multifunctional LED devices 1 to implement a wireless multifunctional speaker system, the sensors integrated in the multifunctional LED devices 100 may detect the position and movements of a person in the room. The multifunctional wireless speaker system may then adjust the multifunctional LED device(s) 100 close to the person and the multifunctional LED device(s) 100 far away from the person accordingly to various algorithms to better broadcast the audio signals. For example, the control unit 11 may amplify certain frequency bands in the multifunctional LED device(s) 100 close to the person. In another example, the control unit 11 may also adjust the lighting (e.g., dimming) in the multifunctional LED device(s) 100 far away from the person.

REFERENCE SIGN LIST

Lampshade 1
LED lighting unit 2
Speaker 3
Outer casing 4
Power supply module 5

Top surface of the outer casing 41
Sound guiding tube 42
Power supply 51
Base 52
Light socket 53
Multifunctional LED device 100
Smart terminal 200
Power supply unit 10
Control unit 11
Audio codec unit 12
Audio power amplifier 13
Speaker 14
Wireless transceiver 15
Wireless transceiver 16
LED light source assembly 17

What is claimed is:

1. A multifunctional LED lighting device, comprising:

an LED power supply unit configured to supply power to an LED lighting unit and drive the multifunctional LED lighting device;

a first wireless transceiver configured to receive and send audio signals and control signals from and to a smart terminal;

a control unit configured to receive from and send signals to the wireless transceiver, to process audio signals and control signals, and to control other components of the multifunctional LED lighting device;

a speaker configured to play audio signals;

an audio power amplifier configured to receive processed audio signals from the control unit and to drive the speaker;

an LED lighting unit configured to emit light according to control signals received from the control unit;

an outer casing configured to hold the LED lighting unit and the speaker; and a sound guiding tube, running through the outer casing, configured to guide sound and dissipate heat;

wherein the outer casing and the sound guiding tube are fully integrated into one piece, and the speaker is located next to the sound guiding tube.

2. The multifunctional LED lighting device according to claim 1, further comprising:

a second wireless transceiver configured to send audio signals and control signals to one or more other multifunctional LED lighting devices.

3. The LED lighting device according to claim 1, wherein:

the control signal includes at least one of adjusting a sound setting of the speaker, switching the multifunctional LED lighting device on or off, adjusting light intensity of the LED lighting unit, and adjusting a color of the LED lighting unit.

4. The LED lighting device according to claim 2, wherein:

the control signal includes at least one of adjusting a sound setting of the speaker of the one or more other multifunctional LED lighting devices, switching the one or more other multifunctional LED lighting devices on or off, adjusting light intensity of the LED lighting unit of the one or more other multifunctional LED lighting devices, and adjusting a color of the LED lighting unit of the one or more other multifunctional LED lighting devices.

5. The LED lighting device according to claim 1, wherein:

the LED lighting unit is further configured to change light color or light intensity according to a rhythm of the audio signals played through the speaker.

6. The LED lighting device according to claim 1, wherein:

the LED lighting unit is further configured to change light color or light intensity according to a volume of the audio signals played through the speaker.

7. The LED lighting device according to claim 1, wherein:

the first wireless transceiver is an RF module configured to connect the multifunctional LED lighting device to Internet to stream music online.

8. The LED lighting device according to claim 1, wherein:

the first wireless transceiver is a Bluetooth module configured to pair the multifunctional LED lighting device with the smart terminal, the smart terminal being installed with an application to send the audio signals to play through the speaker of the multifunctional LED lighting device, and to send the control signals to control other components of the multifunctional LED lighting device.

9. The LED lighting device according to claim 2, wherein:

the first wireless transceiver is a Bluetooth module configured to pair the multifunctional LED lighting device with the smart terminal;

the smart terminal is installed with an application to send the audio signals to the multifunctional LED lighting device, such that the audio signals are played through the speaker of the multifunctional LED lighting device, and through the speaker of the one or more other multifunctional LED lighting devices sent by the second wireless transceiver.

10. A wireless multifunctional sound system, comprising:

a plurality of multifunctional LED lighting devices including:

a first multifunctional LED lighting device with two wireless transceivers including a first wireless transceiver and a second wireless transceiver; and at least a second multifunctional LED lighting device with one wireless transceiver; and a smart terminal configured to monitor and remotely control the multifunctional LED lighting devices;

wherein: the first multifunctional LED lighting device receives signals from the smart terminal through the first wireless transceiver and sends the received signals to the second multifunctional LED lighting device through the second wireless transceiver; and each of the first multifunctional LED lighting device and the second multifunctional LED lighting device further comprises:

an LED lighting unit configured to emit light;

a speaker configured to play audio signals;

an outer casing configured to hold the LED lighting unit and the speaker;

a sound guiding tube, running through the outer casing, configured to guide sound and dissipate heat;

a control unit configured to receive from and send signals to the two wireless transceivers of the first multifunctional LED lighting device or the one wireless transceiver of the second multifunctional LED lighting device, to process audio signals and control signals, and to control other components of the multifunctional LED lighting device; and a power supply module configured to supply power to the LED lighting unit and speaker;

wherein the outer casing and the sound guiding tube are fully integrated into one piece, and the speaker is located next to the sound guiding tube.

11. The wireless multifunctional sound system according to claim 10, wherein the smart terminal sets the first multifunctional LED lighting device as a central device, and the second multifunctional LED lighting device as a receiving device, the central device receiving control signals or audio signals from the smart terminal and sending the signals to the receiving device.

12. The wireless multifunctional speaker system according to claim 10, wherein the smart terminal is a smartphone, a smart TV, a tablet, a desktop computer, or a wireless Dongle.

13. The wireless multifunctional sound system according to claim 10, wherein the first multifunctional LED lighting device and the second multifunctional LED lighting device are configured to form a 2-channel speaker system.

14. A wireless multifunctional sound system, comprising:

at least two multifunctional LED lighting devices each having two wireless transceivers; and a smart terminal configured to monitor and remotely control the multifunctional LED lighting devices;

wherein a first multifunctional LED lighting device receives signals from the smart terminal and sends the received signals to a second multifunctional LED lighting device;

each of the first multifunctional LED lighting device and the second multifunctional LED lighting device further comprises:

an LED lighting unit configured to emit light;

a speaker configured to play audio signals;

an outer casing configured to hold the LED lighting unit and the speaker;

a sound guiding tube, running through the outer casing, configured to guide sound and dissipate heat;

a control unit configured to receive from and send signals to the two wireless transceivers, to process audio signals and control signals, and to control other components of the multifunctional LED lighting device; and a power supply module configured to supply power to the LED lighting unit and speaker;

wherein the outer casing and the sound guiding tube are fully integrated into one piece, and the speaker is located next to the sound guiding tube.

15. The wireless multifunctional sound system according to claim 14, wherein the smart terminal sets the first multifunctional LED lighting device as a central device, and the second multifunctional LED lighting device as a receiving device, the central device receiving control signals or audio signals from the smart terminal and sending the signals to the receiving device.

16. The wireless multifunctional sound system according to claim 14, wherein the smart terminal act as a central device, and the at least two multifunctional LED lighting devices act as receiving devices, the central device sending control signals and audio signals to the receiving devices.

17. The wireless multifunctional sound system according to claim 14, wherein the first multifunctional LED lighting device and the second multifunctional LED lighting device are configured to form a 2-channel speaker system.

18. The wireless multifunctional sound system according to claim 13, wherein the at least two multifunctional LED lighting devices are configured to form a 2.1-channel, a 5.1-channel, or a 7.1-channel speaker system.

19. The wireless multifunctional speaker system according to claim 10, wherein the smart terminal is a smartphone, a smart TV, a tablet, a desktop computer, or a wireless Dongle.

* * * * *